US006287099B1

(12) United States Patent
Chang, II et al.

(10) Patent No.: US 6,287,099 B1
(45) Date of Patent: Sep. 11, 2001

(54) SCROLL COMPRESSOR

(75) Inventors: Young Chang, II, Seoul; Dong Koo Shin, Kyoungki-do, both of (KR)

(73) Assignee: LG Electronics, Inc. (KR)

( * ) Notice: Subject to any disclaimer, the term of this patent is extended or adjusted under 35 U.S.C. 154(b) by 0 days.

(21) Appl. No.: 09/487,002

(22) Filed: Jan. 19, 2000

(30) Foreign Application Priority Data

Jan. 19, 1999 (KR) ..... 99-1429

(51) Int. Cl.[7] ..... F03C 2/00
(52) U.S. Cl. ..... 418/94; 418/55.6; 184/6.18
(58) Field of Search ..... 418/94, 55.6; 184/6.18

(56) References Cited

FOREIGN PATENT DOCUMENTS 57-173589 * 10/1982 (JP) ..... 418/94
59-136596 * 8/1984 (JP) ..... 418/94
59-136598 * 8/1984 (JP) ..... 418/94
59-165887 * 9/1984 (JP) ..... 418/94
59-226294 * 12/1984 (JP) ..... 418/94
59-226295 * 12/1984 (JP) ..... 418/94
62-020601 * 1/1987 (JP) ..... 418/94
02-005787 * 1/1990 (JP) ..... 418/94
04-128586 * 4/1992 (JP) ..... 418/94
04-143489 * 5/1992 (JP) ..... 418/55.6

* cited by examiner

*Primary Examiner*—Thomas Denion
*Assistant Examiner*—Theresa Trieu
(74) *Attorney, Agent, or Firm*—Ostrolenk, Faber, Gerb & Soffen, LLP

(57) ABSTRACT

A scroll compressor is disclosed. In the disclosed scroll compressor, an oil discharge port is formed at a crankshaft of the scroll compressor for discharging a portion of the oil passing through an oil passage formed through the crankshaft to the outside of the crankshaft, a by-pass means is installed at the oil discharge port for opening or closing the oil discharge port by the centrifugal force of the oil generated by the rotation of the crankshaft, and when the compressor is operated at high speed, a portion of oil passing through the oil passage of the crankshaft can be discharged to the outside of the crankshaft and returns to an oil storing portion. Accordingly, excessive supply of oil to a compression portion is prevented, oil consumption is decreased, and the efficiency of volume of the compressor is heightened.

3 Claims, 5 Drawing Sheets

SCROLL COMPRESSOR

BACKGROUND OF THE INVENTION

1. Field of the Invention

The present invention relates to a scroll compressor, and more particularly, to a scroll compressor having a structure capable of causing a portion of oil flowing through an oil passage of a crankshaft to flow out of the crankshaft when the scroll compressor is operated at high speed.

2. Description of the Related Art

As shown in FIG. 1, in a general scroll compressor, a fixed scroll 1 and an orbiting scroll 3 each of which has an involute wrap are engaged with each other to face each other, and therefore a plurality of compression chambers P having large and small crescent shapes are formed by side and bottom surfaces of the fixed scroll 1 and the orbiting scroll 3. Here, the involute wrap of the orbiting scroll 3 is disposed to have a phase difference of 180° with respect to the involute wrap of the fixed scroll 1.

In the above structure, when the orbiting scroll 3 moves in an orbiting motion with respect to the fixed scroll 1, and as a compression chamber having a crescent shape moves toward the center portion of the fixed scroll 1 and the orbiting scroll 3, the volume of the compression chamber is gradually decreased. Consequently, a refrigerant within the fixed scroll 1 and the orbiting scroll 3 is compressed.

Since such a compression operation is continuously and symmetrically performed, the range of variation in load is much narrower than that of a reciprocating compressor or a rotary compressor. Therefore, the scroll compressor is more advantageous than other types of compressors in aspects of vibrations, noises, the efficiency of compression, reliability and the like.

A conventional scroll compressor will be described in detail with reference to FIG. 2. In a conventional scroll compressor, a refrigerant which flows in the compressor through a suction pipe 5 is supplied to the inside of a fixed scroll 1 and an orbiting scroll 3 through a suction port formed at one side of the fixed scroll 1.

At the same time, when electric power is supplied to the stator 7 of a motor, the rotor 9 positioned inside of the stator 7 rotates. In addition, a crankshaft 11 is fixedly inserted in the center portion of the rotor 9, and as the crankshaft 11 rotates with the rotor 9, the orbiting scroll 3 fixed to an eccentric end of the crankshaft 11 moves in an orbiting motion.

At this time, the orbiting scroll 3 revolves without rotating about the fixed scroll 1 by an Oldham ring 15 seated between a main frame 13 and the orbiting scroll 3, and the crankshaft 11 is supported by the main frame 13 and a sub-frame 17 at the upper and lower ends of the crankshaft 11, respectively.

Then, as a compression chamber P is moved toward the center portion by mutual motion of the fixed scroll 1 and the orbiting scroll 3, the volume of the chamber P is gradually decreased, and the refrigerant within the compression chamber P is compressed. The refrigerant thus compressed by the fixed scroll 1 and the orbiting scroll 3 is supplied to a discharge pipe 19 through a discharge port formed at the center portion of the fixed scroll 1, and is then discharged to the outside of the compressor through the discharge pipe 19 and circulated into a refrigeration cycle mechanism.

In addition to the above structure for compressing the refrigerant, the scroll compressor includes a structure for smoothly lubricating a compression portion and a mechanical portion. Such a lubricating structure includes an oil storing portion 21 installed for storing oil at the lower portion of the compressor, an oil passage 12 formed through the inside of the crankshaft 11 so that the oil within the oil storing portion 21 can be delivered to the compression portion and the mechanical portion, and an oil pump 23 for supplying the oil within the oil storing portion 21 to the oil passage 12. Usually, a centrifugal pump, a volummetric pump, a pressure difference pump or the like is used as an oil pump.

However, since, in the above conventional scroll compressor, the amount of oil supplied by the oil pump 23 is increased in proportion to the rpm of the compressor, oil is excessively supplied when the compressor is operated at high speed and the amount of oil supplied to the compression portion is increased. Accordingly, the amount of discharged oil is increased, and there is a problem in which the efficiency of volume of the compressor is lowered.

SUMMARY OF THE INVENTION

To solve the above problem, it is an objective of the present invention to provide a scroll compressor having a structure capable of causing a portion of oil flowing through an oil passage of a crankshaft to flow out of the crankshaft when the scroll compressor is operated at high speed so that excessive supply of oil to a compression portion is prevented, oil consumption is decreased, and the efficiency of volume of the compressor is heightened.

Accordingly, to achieve the above objective, there is provided a scroll compressor comprising a fixed scroll and an orbiting scroll engaged with each other and forming a compression chamber to compress a refrigerant, and a crankshaft one end of which is connected to the orbiting scroll so as to cause the orbiting scroll to revolve and through the center portion of which an oil passage is formed for passing the oil supplied by an oil pump, wherein an oil discharge port is formed at the crankshaft for discharging the oil passing through the oil passage to the outside of the crankshaft; and a by-pass means which is operated by the centrifugal force of the oil generated by the rotation of the crankshaft and opens or closes the oil discharge port depending on the rotation speed of the crankshaft 61 is installed at the oil discharge port.

In addition, according to one aspect of the present invention, the by-pass means comprises a ball valve installed at the oil discharge port so as to move forward or backward by the centrifugal force of the oil for opening or closing the oil discharge port; and an elastic means installed at the crankshaft for pressing the ball valve against the oil discharge port, and the oil discharge port is formed in a funnel shape the sectional area of which becomes wider toward the outer portion of the crankshaft.

According to another aspect of the present invention, the by-pass means comprises a cylindrical valve installed at an oil discharge port to move forward or backward by the centrifugal force of oil for opening or closing the oil discharge port, an elastic means disposed at the outer side of the cylindrical valve for pressing the cylindrical valve against the oil discharge port, and a support means installed at the crankshaft for supporting the elastic means; and the oil discharge port communicates with a cylindrical receiving portion in which the by-pass means including the cylindrical valve is installed, and the inner end portion of the receiving portion communicates with a passage formed to communicate with the outside of the crankshaft.

With the scroll compressor configured as above according to the present invention, since a portion of oil passing through the oil passage of the crankshaft can be discharged to the outside of the crankshaft by providing the oil discharge passage and the by-pass means when the scroll compressor is operated at high speed, excessive supply of oil to a compression portion is prevented, oil consumption is decreased, and the efficiency of volume of the compressor is heightened.

BRIEF DESCRIPTION OF THE DRAWINGS

The above objective and advantages of the present invention will become more apparent by describing in detail preferred embodiments thereof with reference to the attached drawings in which.

DESCRIPTION OF THE PREFERRED EMBODIMENTS

Figure 1:
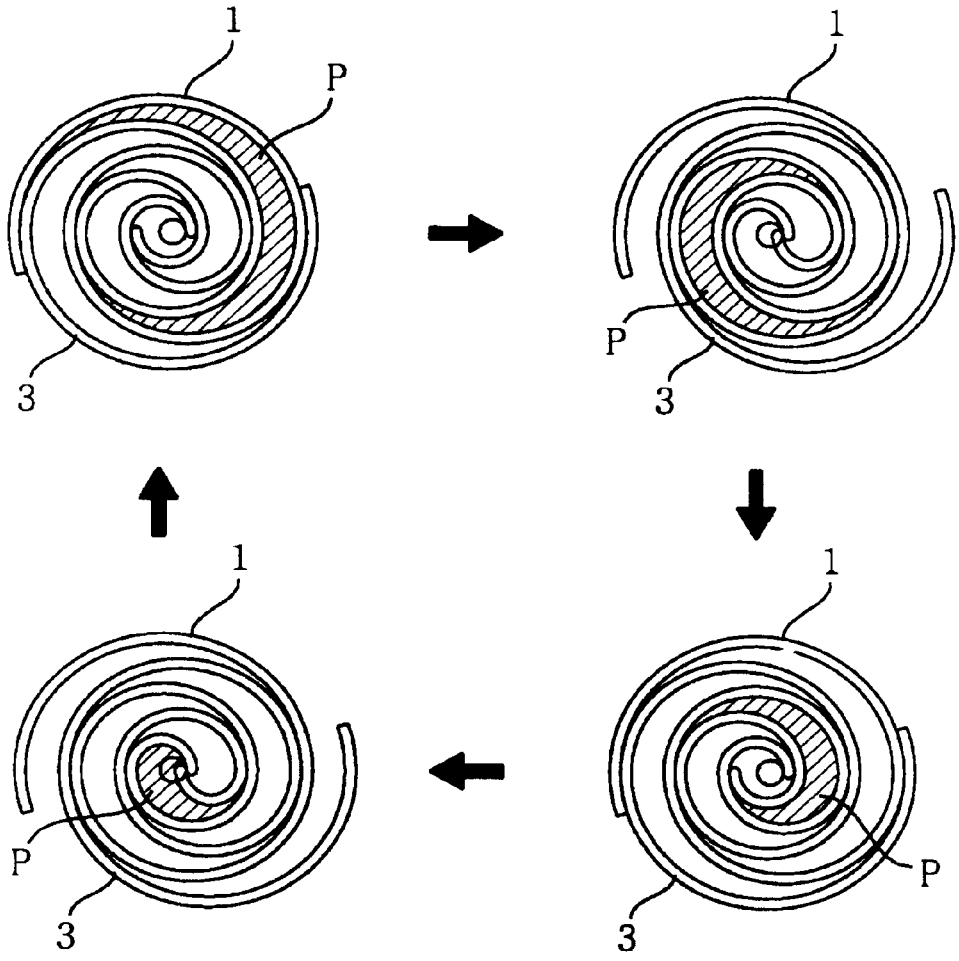
FIG.1 (Prior Art)
FIG. 1 is a diagram illustrating the compression principle of a general scroll compressor.
Figure 2:
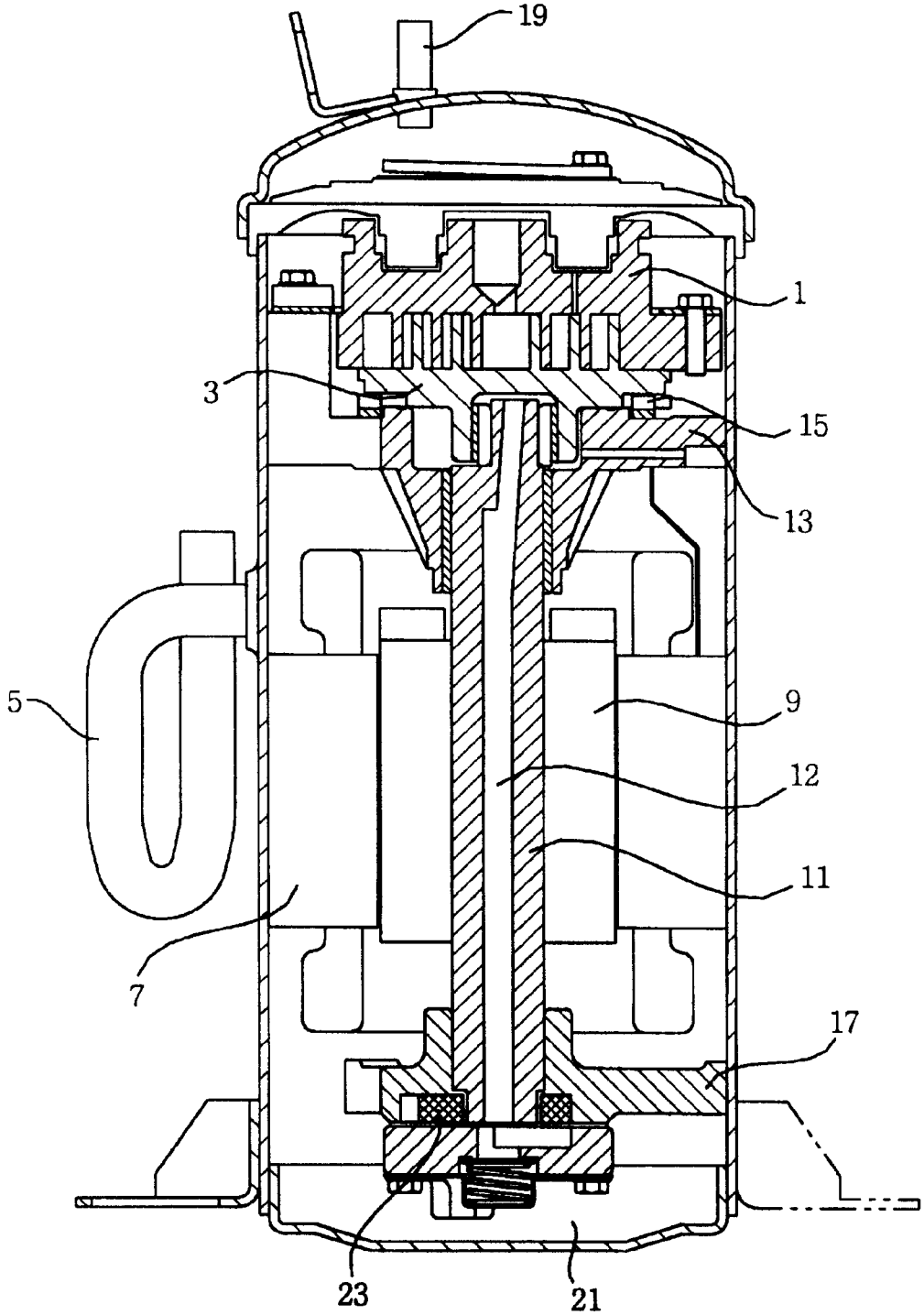
FIG.2 (Prior Art)
FIG. 2 is a partially sectional elevational view illustrating the structure of a conventional scroll compressor.
Figure 3:
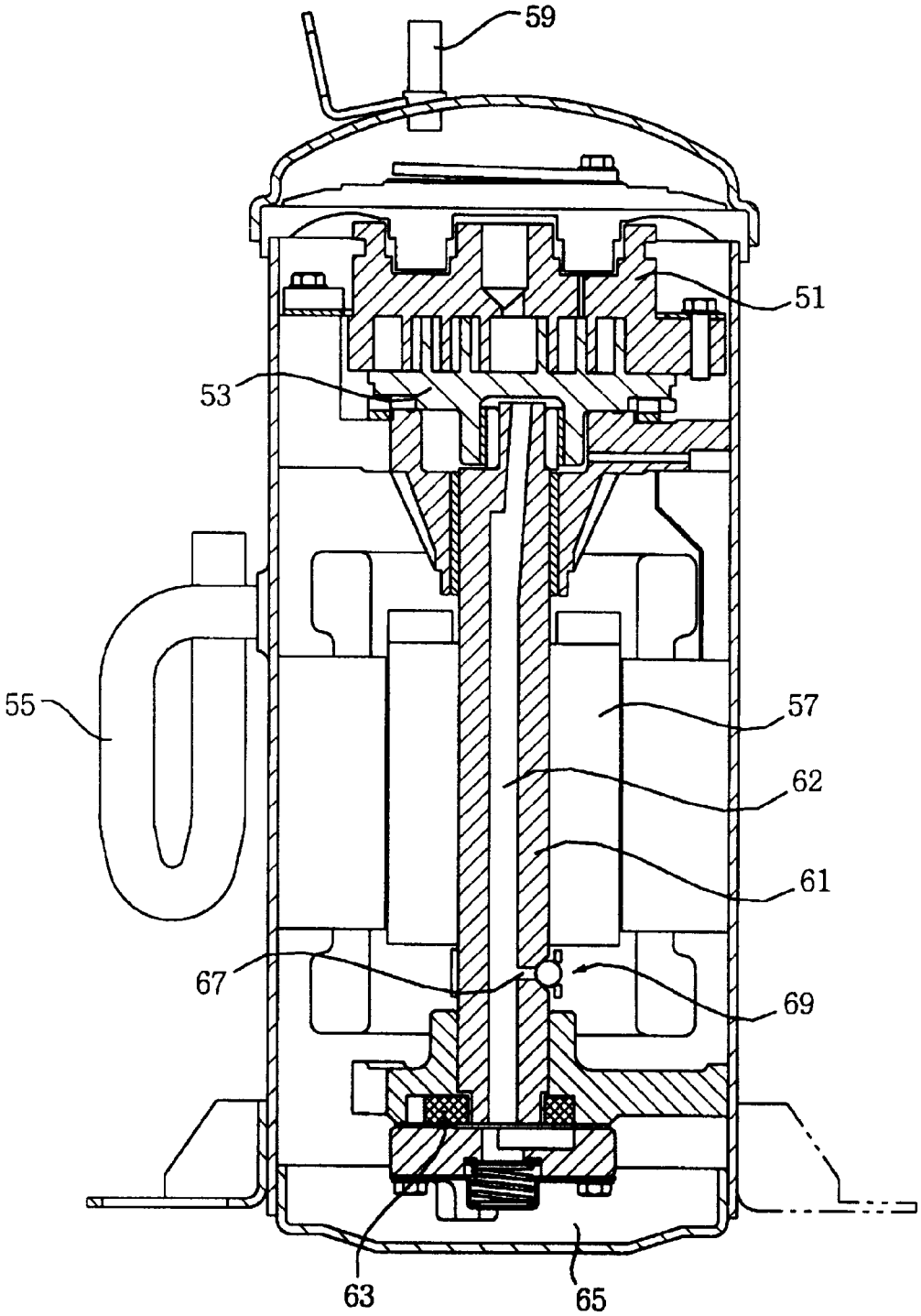
FIG. 3 is a partially sectional elevational view illustrating the structure of a scroll compressor according to the present invention.

As shown in FIG. 3, a scroll compressor according to the present invention includes a fixed scroll 51 and a orbiting scroll 53 which are engaged with each other and form a compression chamber so that a refrigerant can be compressed in the compression chamber, and a crankshaft 61 one end of which is connected to the orbiting scroll 53 so as to cause the orbiting scroll 53 to revolve and through the center portion of which an oil passage is formed for passing the oil supplied by an oil pump 63. Here, an oil discharge port 67 is formed at the crankshaft 61 for discharging the oil flowing through the oil passage 62 to the outside of the crankshaft 61, and a by-pass means 69 which is operated by the centrifugal force of the oil generated by the rotation of the crankshaft 61 and opens or closes the oil discharge port depending on the rotation speed of the crankshaft 61 is installed at the oil discharge port 67.

Figure 4:
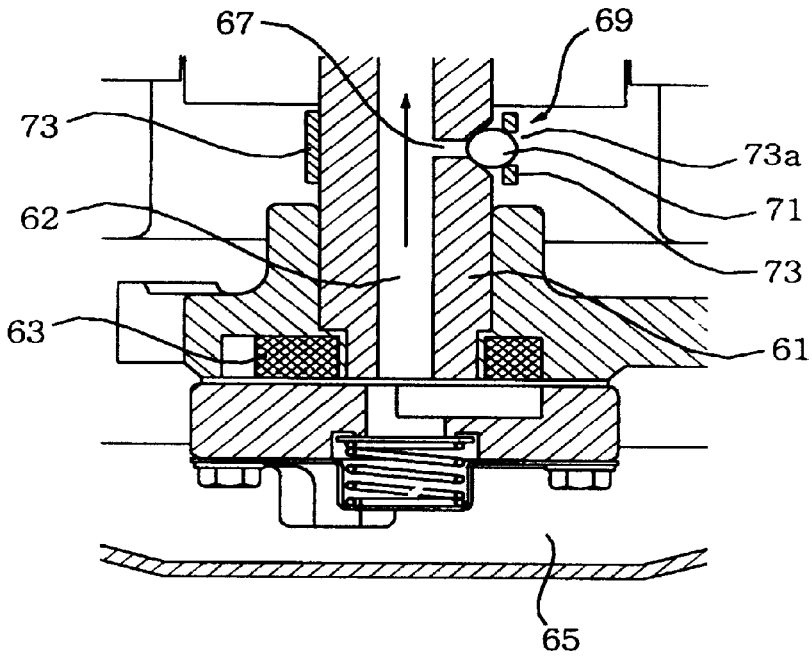
FIGS. 4 and 5 are enlarged partially sectional elevational views illustrating a by-pass means included in a scroll compressor according to the present invention.
Figure 5:
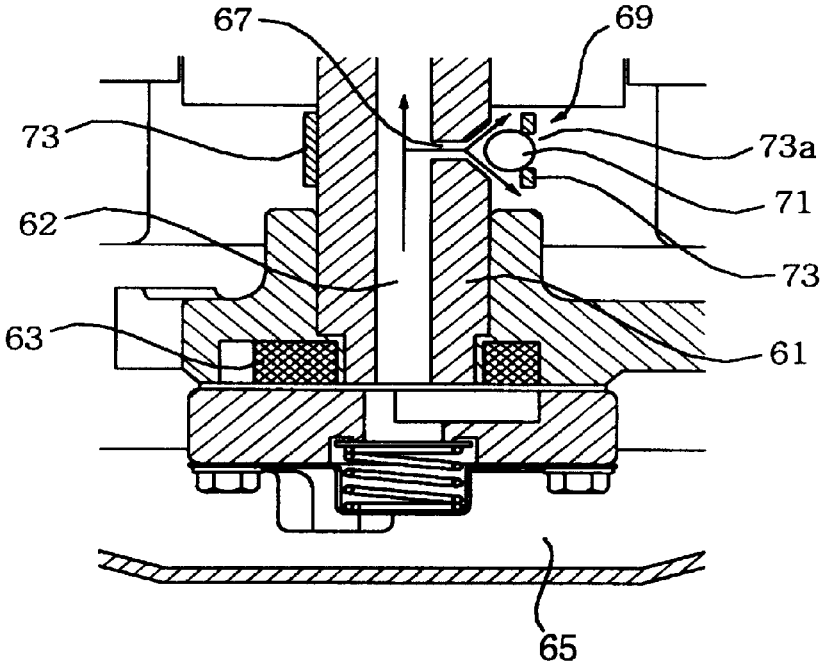

Here, as shown in FIGS. 4 and 5, the by-pass means 69 comprises a ball valve 71 installed at the oil discharge port 67 so as to move forward or backward by the centrifugal force of the oil for opening or closing the oil discharge port 67, and an elastic belt 73 wound around the crankshaft 61 in a pressed state and providing a compression force to the ball valve 71 so that the ball valve 71 can be pressed against the oil discharge port 67. The elastic belt 73 is configured so that a hole 73*a* is formed at one portion of the elastic belt 73 and one side of the ball valve 71 can be fitted into the hole 73*a*.

In addition, the oil discharge port 67 is formed in a funnel shape the sectional area of which becomes wider toward the outer portion of the crankshaft 61.

In the scroll compressor configured as above according to the present invention, when the refrigerant which has flowed in the inside of the compressor through a suction pipe 55 is supplied to the inside of the fixed scroll 51 and the orbiting scroll 53 through a suction port formed at one side of the fixed scroll 51, the rotor 57 of a motor is operated, and the crankshaft 61 fixedly installed through the rotor 57 rotates.

When the crankshaft 61 rotates, the orbiting scroll 53 connected to an eccentric end of the crankshaft 61 revolves, and as the compression chamber having a crescent shape and formed between the fixed scroll 51 and the orbiting scroll 53 is moved toward the center portion of the fixed scroll 51 by the revolution of the orbiting scroll 53, the volume of the compression chamber is gradually decreased and the refrigerant is compressed.

Then, after the refrigerant compressed by the fixed scroll 51 and the orbiting scroll 53 is supplied to a discharge pipe 59 through a discharge port formed at the center portion of the fixed scroll 51, the refrigerant is discharged to the outside of the compressor through the discharge pipe 59 and circulated into a refrigeration cycle mechanism.

While the refrigerant is compressed as described above, the compression portion and mechanical portion of the compressor is supplied with oil for lubrication. That is, the oil stored in the oil storing portion 65 is supplied to bearings, thrust surfaces and the compression portion through the oil passage 62 and performs lubrication function.

At this time, when the compressor is operated at low speed, the pressing force of the elastic belt 73 which presses the ball valve 71 toward the oil discharge port 67 so that the ball valve 71 may block the oil discharge port 67 of the crankshaft 61 is greater than the centrifugal force of the ball valve 71 and the centrifugal force of the oil passing through the oil passage 62 of the crankshaft 61. Therefore, as shown in FIG. 4, the ball valve 71 continues to block the oil discharge port, and all the oil supplied to the oil passage 62 by the oil pump 63 is supplied to the compression portion and the mechanical portion.

To the contrary, when the compressor is operated at higher speed than a preset speed, the centrifugal force of the ball valve 71 and the centrifugal force of the oil passing through the oil passage 62 is greater than the pressing force of the elastic belt 73 which presses the ball valve 71 toward the oil discharge port 67. Therefore, as shown in FIG. 5, the ball valve 71 moves toward the outer side of the crankshaft 61 and opens the oil discharge port 67. Accordingly, since a portion of the oil passing through the oil passage 62 is discharged to the outside of the crankshaft 61 through the oil discharge port 67 and returns to the oil storing portion 65, excessive supply of oil to the compression portion is prevented.

Figure 6:
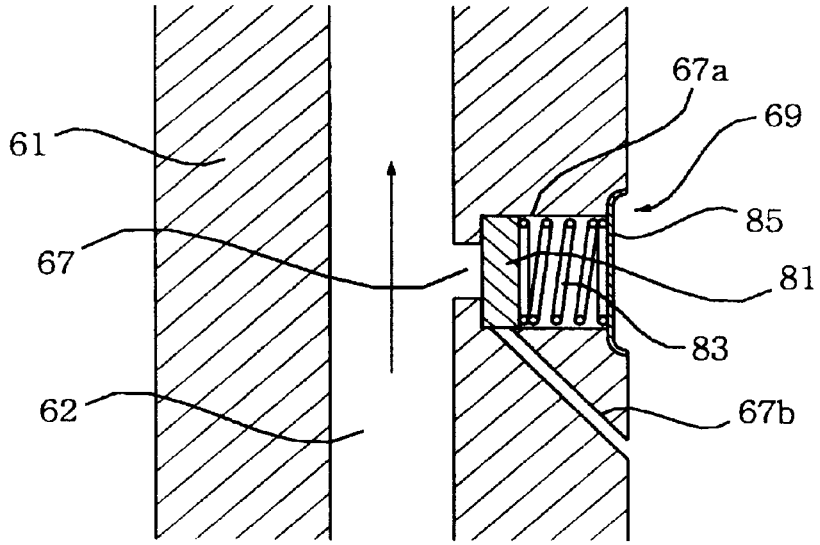
FIGS. 6 and 7 are enlarged partially sectional elevational views illustrating a by-pass means according to another embodiment of the present invention.
Figure 7:
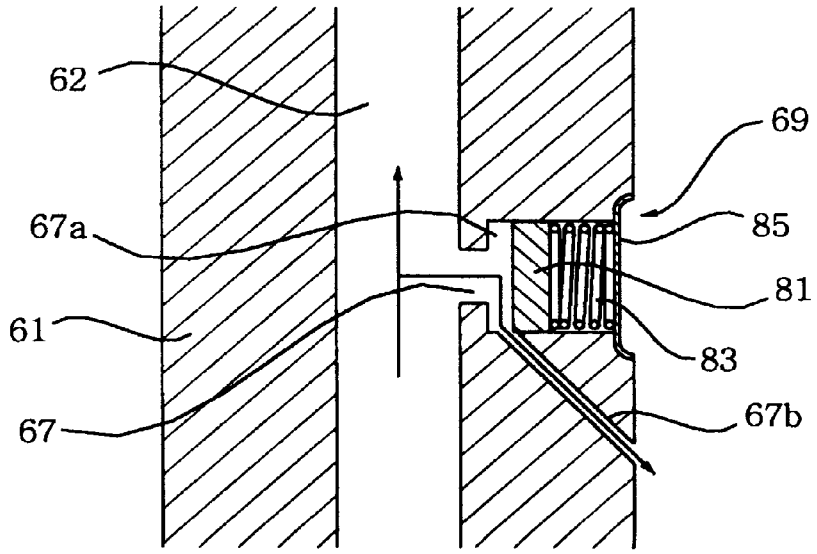

In addition, as shown in FIGS. 6 and 7, a by-pass means 69 according to another embodiment of the present invention comprises a cylindrical valve 81 installed at an oil discharge port 67 to move forward or backward by the centrifugal force of oil for opening or closing the oil discharge port 67, a spring 83 for providing an elastic force to the cylindrical valve 81 so that the cylindrical valve 81 can move forward or backward, and a fixed cover 85 fixed to the crankshaft 61 for supporting the spring 83.

The oil discharge port 67 communicates with a cylindrical receiving portion 67*a* in which the by-pass means 69 including the cylindrical valve 81 is installed, and the receiving portion 67*a* communicates with a passage 67*b* formed to communicate with the outside of the crankshaft 61 at the inner portion of the receiving portion 67*a*.

In the above structure, when the compressor is operated at low speed, the pressing force of the spring 83 which presses the cylindrical valve 81 toward the oil discharge port 67 so that the cylindrical valve 81 may block the oil discharge port 67 of the crankshaft 61 is greater than the centrifugal force of the cylindrical valve 81 and the centrifugal force of the oil passing through the oil passage 62 of the crankshaft 61.

Therefore, as shown in FIG. 6, the cylindrical valve 81 continues to block the oil discharge port, and all the oil supplied to the oil passage 62 by the oil pump 63 is supplied to the compression portion and the mechanical portion.

To the contrary, when the compressor is operated at higher speed than a preset speed, the centrifugal force of the cylindrical valve 81 and the centrifugal force of the oil passing through the oil passage 62 is greater than the pressing force of the spring 83 which presses the cylindrical valve 81 toward the oil discharge port 67. Therefore, as shown in FIG. 7, the cylindrical valve 81 moves toward the outer side of the crankshaft 61 and opens the oil discharge port 67. Accordingly, since a portion of the oil passing through the oil passage 62 is discharged to the outside of the crankshaft 61 through the passage 67*b* of the oil discharge port 67 and returns to the oil storing portion 65, excessive supply of oil to the compression portion is prevented.

In the scroll compressor configured and operated as described above according to the present invention, when the compressor is operated at higher speed than a preset speed, the by-pass means 69 which blocks the oil discharge port 67 of the crankshaft 61 is operated and opens the oil discharge port 67, and a portion of the oil passing through the oil passage 62 of the crankshaft 61 returns to the oil storing portion 65 the oil discharge port 67. Therefore, excessive supply of oil to a compression portion is prevented, oil consumption is decreased, and the efficiency of volume of the compressor is heightened.

What is claimed is:

1. A scroll compressor comprising:

a fixed scroll;

an orbiting scroll engaged with said fixed scroll, said scrolls forming a compression chamber each other to compress a refrigerant;

a crankshaft one end of which is connected to the orbiting scroll so as to cause the orbiting scroll to revolve and through the center portion of which an oil passage is formed for passing the oil supplied by an oil pump;

an oil discharge port formed at the crankshaft for discharging the oil passing through the oil passage to the outside of the crankshaft; and a by-pass operated by the centrifugal force generated by the rotation of the crankshaft to open or close the oil discharge port depending on the rotation speed of the crankshaft, and installed at the oil discharge port;

wherein the by-pass comprises a ball valve installed at the oil discharge port so as to move forward or backward by the centrifugal force of the oil for opening or closing the oil discharge port; and an elastic belt wound around the crankshaft, and a hole is formed at the elastic belt and a portion of the ball valve is inserted in the hole.

2. The scroll compressor as claimed in claim 1, wherein the oil discharge port is formed in a funnel shape the sectional area of which becomes wider toward the outer portion of the crankshaft.

3. A scroll compressor comprising:

a fixed scroll;

an orbiting scroll engaged with said fixed scroll, said scrolls forming a compression chamber each other to compress a refrigerant;

a crankshaft one end of which is connected to the orbiting scroll so as to cause the orbiting scroll to revolve and through the center portion of which an oil passage is formed for passing the oil supplied by an oil pump;

an oil discharge port formed at the crankshaft for discharging the oil passing through the oil passage to the outside of the crankshaft; and a by-pass operated by the centrifugal force generated by the rotation of the crankshaft to open or close the oil discharge port depending on the rotation speed of the crankshaft, and installed at the oil discharge port, wherein the by-pass comprises a cylindrical valve installed at an oil discharge port to move forward or backward by the centrifugal force of oil for opening or closing the oil discharge port; an elastic member disposed at the outer side of the cylindrical valve for processing the cylindrical valve against the oil discharge port; and a support installed at the crankshaft for supporting the elastic member, wherein the oil discharge port communicates with a cylindrical receiving portion in which the by-pass including the cylindrical valve is installed, and the inner end portion of the receiving portion communicates with a passage formed to communicate with the outside of the crankshaft.

* * * * *